United States Patent [19]

Sekiguchi et al.

[11] 4,279,786

[45] Jul. 21, 1981

[54] HOMOGENEOUS AQUEOUS ALPHA-OLEFIN SULFONATE COMPOSITION

[75] Inventors: Shizuo Sekiguchi, Funabashi; Tetsuo Tano; Kyozo Kitano, both of Chiba, all of Japan

[73] Assignee: The Lion Fat & Oil Co., Ltd., Tokyo, Japan

[21] Appl. No.: 102,827

[22] Filed: Dec. 12, 1979

[30] Foreign Application Priority Data

Dec. 26, 1978 [JP] Japan ..... 53/162084

[51] Int. Cl.[3] ..... C11D 3/34

[52] U.S. Cl. ..... 252/536; 252/546; 252/555; 252/121; 252/DIG. 14

[58] Field of Search ..... 252/536, 546, 555, 121, 252/DIG 14

[56] References Cited

U.S. PATENT DOCUMENTS

| | | | |
|---|---|---|---|
| 3,415,753 | 12/1968 | Stein et al. | 252/536 X |
| 3,970,596 | 7/1976 | Klisch et al. | 252/555 X |
| 4,003,857 | 1/1977 | Gorsich et al. | 252/555 X |
| 4,061,586 | 12/1977 | Klisch et al. | 252/555 X |
| 4,107,095 | 8/1978 | Klisch et al. | 252/555 X |

*Primary Examiner*—Mayer Weinblatt
*Attorney, Agent, or Firm*—Armstrong, Nikaido, Marmelstein & Kubovcik

[57] ABSTRACT

A homogeneous aqueous alpha-olefin sulfonate composition, which does not form "liquid crystal" due to temperature change and/or with the lapse of time, is presented. This composition contains, as a "liquid crystal" formation inhibitor, approximately 1 to approximately 10 parts by weight, based on 100 parts by weight of the alpha-olefin sulfonate, of at least one additive selected from the group consisting of allyl sulfonic acid, methallyl sulfonic acid, sorbic acid, gluconic acid, malic acid and the salts of said acids.

3 Claims, No Drawings

HOMOGENEOUS AQUEOUS ALPHA-OLEFIN SULFONATE COMPOSITION

FIELD OF THE INVENTION

This invention relates to homogeneous aqueous alpha-olefin sulfonate compositions. More specifically, it relates to homogeneous aqueous alpha-olefin sulfonate compositions which do not generate "liquid crystal" therein even due to temperature changes and/or with the lapse of time.

DESCRIPTION OF THE PRIOR ART

It is known that aqueous alpha-olefin sulfonate compositions tend to remarkably increase the viscosity thereof when the concentration thereof exceeds approximately 30% by weight. These remarkable increases in the viscosities of the aqueous alpha-olefin sulfonate compositions cause handling problems during, for example, pumping of the aqueous alpha-olefin sulfonate compositions.

An improvement of the handling problems of aqueous alpha-olefin sulfonate compositions has been proposed in, for example, U.S. Pat. No. 3,415,753. This patent teaches that the viscosity of aqueous alpha-olefin monosulfonate compositions can be reduced by means of alpha-olefin disulfonates which are produced as a minor component during the production of alpha-olefin monosulfonates. U.S. Pat. No. 4,003,857 discloses the use of formates, such as sodium formate, for preventing gel formation in aqueous alpha-olefin sulfonate solutions, to facilitate the handling of said composition. In addition, U.S. Pat. No. 3,954,679 discloses the use of water-soluble inorganic halide salts, such as sodium chloride, as a viscosity reducing agent, in aqueous alpha-olefin sulfonate detergent compositions.

However, aqueous alpha-olefin sulfonate compositions have a problem, other than said viscosity increase and gel formation problems, in that they have a tendency to form "liquid crystals" due to the temperature changes and/or with the lapse of time. This tendency becomes remarkable with the increase in the concentration of the aqueous alpha-olefin sulfonate compositions. The formation of the "liquid crystals" inherently occurs in the aqueous alpha-olefin sulfonate compositions in the following manner. Namely, alpha-olefin sulfonate which is dissolved, as spherical micelle, in an aqueous medium is partially changed from spherical micelle to laminar or lamellar micelle due to the temperature changes and/or with the lapse of time. The laminar micelle is in turn changed to the "liquid crystal". The formation of the "liquid crystal" causes turbidity in the aqueous alpha-olefin sulfonate composition, and finally, the aqueous solution separates into two phases, due to the difference in specific gravity, one of which is a clear upper layer and the other is cloudy or translucent lower layer.

The formation of the "liquid crystal" in the aqueous alpha-olefin sulfonate composition not only impairs the handling property of the aqueous alpha-olefin sulfonate composition but, also, adversely affects the value of said aqueous composition, as a commercial product. Therefore, the problem of the formation of the "liquid crystal", as well as the above-mentioned viscosity increase and gelling problems, should be solved. However, the problem of the formation of the "liquid crystal" is the aqueous alpha-olefin sulfonate composition can be solved by neither a known viscosity reducing agent nor a known gel inhibitor.

SUMMARY OF THE INVENTION

The objects of this invention are to obviate the aforementioned problem of the conventional aqueous alpha-olefin sulfonate compositions and to provide aqueous alpha-olefin sulfonate compositions which are capable of preventing the formation of the "liquid crystal", as well as the formation of the laminar micelle therein, even in the case of the occurrence of temperature changes and with the lapse of time.

Other objects and advantages of this invention will be apparent from the description set forth hereinbelow.

In accordance with this invention, there is provided a homogeneous aqueous alpha-olefin sulfonate composition comprising:

A. 100 parts by weight, in terms of alpha-olefin sulfonate, of an aqueous solution of at least one alpha-olefin sulfonate having from 10 to 20 carbon atoms, and;

B. from approximately 1 to approximately 10 parts by weight of at least one additive selected from the group consisting of allyl sulfonic acid, methallyl sulfonic acid, sorbic acid, gluconic acid, malic acid and the salts of said acids. This homogeneous aqueous alpha-olefin sulfonate composition can be prepared by adding from approximately 1 to approximately 10 parts by weight of at least one additive selected from the group consisting of allyl sulfonic acid, methallyl sulfonic acid, sorbic acid, gluconic acid, malic acid and the salts of said acids to 100 parts by weight, in terms of alpha-olefin sulfonate, of an aqueous solution of at least one alpha-olefin sulfonate having from 10 to 20 carbon atoms.

DESCRIPTION OF THE PREFERRED EMBODIMENTS

According to this invention, an aqueous alpha-olefin sulfonate solution having a high concentration, for example, from approximately 30% by weight to approximately 50% by weight, of the sulfonate does not cause formation of a "liquid crystal", due to temperature changes and/or with the lapse of time, since the special additive set forth in the SUMMARY OF THE INVENTION above, is included in the aqueous solution.

An aqueous alpha-olefin sulfonate solution is generally produced by sulfonating alpha-olefin with gaseous sulfur trioxide ($SO_3$) diluted with an inert gas, such as air or nitrogen and, then, neutralizing the resultant mixture with an aqueous alkaline solution followed by heat hydrolysis. However, in the case where an aqueous alpha-olefin sulfonate solution is used for detergent compositions, an alpha-olefin having from 10 to 20 carbon atoms is used as a starting olefin and a mild sulfonation is carried out to form a sulfonated product having a pale color. For instance, the mole ratio of $SO_3$ to alpha-olefin is usually within the range of from 1.0 to 1.15, preferably from 1.0 to 1.1. Examples of the aqueous alkaline solutions used in the neutralization and hydrolysis of the sulfonated products are aqueous alkali metal hydroxide solutions, aqueous alkaline earth metal hydroxide solutions and aqueous alkaline earth metal oxide solutions, and these aqueous alkaline solutions are optionally used separately or jointly. Examples of these aqueous alkaline solutions are the solutions of lithium hydroxide, sodium hydroxide, potassium hydroxide and magnesium hydroxide.

Typical examples of alpha-olefin sulfonates used in this invention are: lithium, sodium, potassium and magnesium salts of alpha-olefin sulfonic acids having 18 carbon atoms; lithium, sodium, potassium and magnesium salts of alpha-olefin sulfonic acids having 16 carbon atoms; lithium, sodium, potassium and magnesium salts of alpha-olefin sulfonic acids having 14 carbon atoms; lithium, sodium, potassium and magnesium salts of mixed alpha-olefin sulfonic acids of $C_{15}$ to $C_{18}$; lithium, sodium, potassium and magnesium salts of mixed alpha-olefin sulfonic acids of $C_{14}$ to $C_{18}$; lithium, sodium, potassium and magnesium salts of mixed alpha-olefin sulfonic acids of $C_{12}$ to $C_{14}$; and the like.

The additives used in this invention have a function of preventing the formation of the "liquid crystal" of the alpha-olefin sulfonates or destroying the "liquid crystals" of the alpha-olefin sulfonate. Examples of such additives are allyl sulfonic acid, methallyl sulfonic acid, sorbic acid, gluconic acid, malic acid and the salts of said acids. Such salts include, lithium, sodium, potassium and magnesium salts.

The inclusion of the additive in the aqueous alpha-olefin sulfonate can be effected in any manner. For instance, the additive is added to sulfonated alpha-olefin prior to the neutralization and hydrolysis, and then, the sulfonated alpha-olefin is neutralized and hydrolyzed. Alternatively, the additive can be added to an aqueous alpha-olefin sulfonate solution. The important point is that approximately 1 to approximately 10 parts by weight of the aforementioned additive or additives, based on 100 parts by weight of alpha-olefin sulfonates or sulfonates, are contained in the resultant aqueous alpha-olefin sulfonate solution in a neutral or weak alkaline state. When the amount of the aforementioned additive or additives is less than 1 part by weight, the formation of the "liquid crystal" in the aqueous alpha-olefin sulfonate solution can not be prevented. On the other hand, when the amount of the additive or additives is more than 10 parts by weight, a further increase in the effect for preventing the formation of the "liquid crystal" can not be expected.

EXAMPLES

This invention now will be further illustrated by, but is by no means limited to, the following Examples.

EXAMPLE 1

Mixed alpha-olefins of $C_{14}$ and $C_{16}$ having an average molecular weight of 205 were sulfonated with a diluted gaseous $SO_3$ ($SO_3$ content = 1.5% by volume) in a laboratory scale film type reactor made of glass under the conditions of a reaction temperature of 50° C. and a mole ratio of $SO_3$ to the olefins of 1.05. The sulfonated products were equally divided into four portions. These portions were separately neutralized with various aqueous sodium hydroxide solutions having different concentrations. The resultant neutralized products were then hydrolyzed in a one liter autoclave, respectively, for 20 minutes at a temperature of 160° C. As a result, aqueous alpha-olefin sufonate solutions having a concentration alpha-olefin sulfonate of 35%, 36%, 37% and 38%, all by weight, were obtained.

The conversion of the sulfonation reaction, determined by an ether extraction method, was 96.5%. The color tone of each aqueous solution obtained was determined with respect to a 5% by weight solution by using an absorption photometer made by Hitachi Seisaku Sho, under the conditions of a wavelength of 420 microns and a slit width of 0.05 mm. A 10 mm glass cell was used. All the results were $$-\log T = 35 \times 10^3.$$

The various organic acid salts listed in TABLE 1 below were added to the four aqueous alpha-olefin sulfonate solutions obtained as mentioned above, and the temperatures at which the "liquid crystal" were formed were determined while the temperatures were gradually increased. The appearance after each solution was allowed to stand for seven days at a room temperature was also observed. The results are shown in TABLE 1 below.

TABLE 1

| No. | Concentration of Alpha-Olefin Sulfonate in Solution(wt.%) | Organic Acid Salt Added | Addition Amount of Acid Salt (part by weight)*1 | "Liquid Crystal" Formation Temperature (°C.) | Appearance After 7 Days at Room Temp. |
|---|---|---|---|---|---|
| 1*2 | 35 | None | — | 76 | cloud |
| 2*2 | 36 | " | — | 46 | " |
| 3*2 | 37 | " | — | 32 | " |
| 4*2 | 38 | " | — | 22 | " |
| 5*2 | 37 | Sodium Citrate | 5 | 35 | " |
| 6*2 | 37 | Sodium Tartrate | 5 | 37 | " |
| 7 | 35 | Sodium Malate | 5 | ≧90 | clear |
| 8 | 36 | Sodium Malate | 5 | ≧90 | " |
| 9*2 | 37 | Sodium Malate | 0.5 | 49 | cloud |
| 10 | 37 | Sodium Malate | 1 | ≧90 | clear |
| 11 | 37 | Sodium Malate | 5 | ≧90 | " |
| 12 | 38 | Sodium Malate | 5 | ≧90 | " |
| 13 | 35 | Sodium Allyl Sulfonate | 5 | ≧90 | " |
| 14 | 36 | Sodium Allyl Sulfonate | 5 | ≧90 | " |

TABLE 1-continued

| No. | Concentration of Alpha-Olefin Sulfonate in Solution(wt.%) | Organic Acid Salt Added | Addition Amount of Acid Salt (part by weight)*1 | "Liquid Crystal" Formation Temperature (°C.) | Appearance After 7 Days at Room Temp. |
|---|---|---|---|---|---|
| 15*2 | 37 | Sodium Allyl Sulfonate | 0.5 | 67 | cloud |
| 16 | 37 | Sodium Allyl Sulfonate | 1 | ≧90 | clear |
| 17 | 37 | Sodium Allyl Sulfonate | 5 | ≧90 | " |
| 18 | 38 | Sodium Allyl Sulfonate | 5 | ≧90 | " |
| 19 | 37 | Sodium Methallyl Sulfonate | 5 | ≧90 | " |
| 20 | 37 | Sodium Sorbate | 5 | ≧90 | " |
| 21 | 35 | Gluconic Acid | 5 | ≧90 | " |
| 22*2 | 37 | " | 0.5 | 51 | cloud |
| 23 | 37 | " | 1 | ≧90 | clear |
| 24 | 37 | " | 5 | ≧90 | " |
| 25 | 40 | " | 5 | 85 | " |

*1Parts by weight based on 100 parts by weight of alpha-olefin sulfonate
*2Comparative Examples

EXAMPLE 2

An aqueous alpha-olefin sulfonate solution having an alpha-olefin sulfonate concentration of 43% by weight was prepared in the manner described in Example 1, except that alpha-olefin having 14 carbon atoms was used as a starting olefin. To the aqueous alpha-olefin sulfonate solution thus obtained, 5 parts by weight, based on 100 parts by weight of the alpha-olefin sulfonate, of sodium allyl sulfonate was added. With respect to the aqueous alpha-olefin sulfonate solution thus obtained, the "liquid crystal" formation temperature and the appearance of the solution after being allowed to stand for seven days at a room temperature were determined as in Example 1.

As a result, although the "liquid crystal" was formed in the aqueous alpha-olefin sulfonate solution containing no sodium allyl sulfonate at a temperature of 36° C., no "liquid crystal" was formed in the aqueous alpha-olefin sulfonate solution containing sodium allyl sulfonate even in the case where the temperature of the aqueous solution was raised to more than 90° C. Furthermore, when both the aqueous alpha-olefin sulfonate solutions containing no and said amount of sodium allyl sulfonate were allowed to stand for seven days at room temperature, it was observed that the solution containing sodium allyl sulfonate was clear, whereas the solution containing no sodium allyl sulfonate was turbid.

The conversion of the sulfonation reaction, which was determined in a manner as described in Example 1, was 95.7%. The color tone of the resultant aqueous alpha-olefin sulfonate solution, which was determined in a manner as described in Example 1, was as follows.

$$-\log T = 26 \times 10^3$$

EXAMPLE 3

An aqueous alpha-olefin sulfonate solution containing 36% by weight of sodium alpha-olefin sulfonates having 14 to 16 carbon atoms was prepared in the manner described in Example 1. 100 g of the aqueous alpha-olefin sulfonate solution was charged into and the pH thereof was adjusted to 7, as measured by a pH meter, with a 20% aqueous sulfuric acid solution.

Then, into this solution, a homogeneous aqueous solution containing 0.72 g of malic acid (corresponding to 2% by weight of the alpha-olefin sulfonate) and 0.31 g of magnesium hydroxide (which was equivalent to the malic acid) together with a small amount of water was added. After this mixture was agitated for approximately 1 hour at a room temperature, the pH of this mixture was adjusted to 7.5 by adding several drops of an aqueous magnesium hydroxide dispersion. The temperature at which the "liquid crystal" began to form was more than 90° C., when the "liquid crystal" formation temperature was determined in the manner described in Example 1.

What we claim is:

1. A homogeneous aqueous alpha-olefin sulfonate composition consisting essentially of:

A. 100 parts by weight, in terms of alpha-olefin sulfonate, of an aqueous solution of at least one alpha-olefin sulfonate having from 10 to 20 carbon atoms; and B. from approximately 1 to approximately 10 parts by weight of at least one additive selected from the group consisting of sorbic acid, gluconic acid, malic acid and the salts of said acids.

2. A homogeneous aqueous alpha-olefin sulfonate composition as claimed in claim 1, wherein the concentration of said aqueous alpha-olefin sulfonate solution is within the range of from approximately 30 to approximately 50% by weight.

3. A homogeneous aqueous alpha-olefin sulfonate composition as claimed in claim 1, wherein the salts of said acids are lithium, sodium, potassium and magnesium salts.

* * * * *